US011846185B2

(12) United States Patent
Hahn et al.

(10) Patent No.: US 11,846,185 B2
(45) **Date of Patent: *Dec. 19, 2023**

(54) LATERAL BOREHOLES IN AN EARTH FORMATION

(71) Applicant: SHELL OIL COMPANY, Houston, TX (US)

(72) Inventors: Robert Theodore Hahn, Houston, TX (US); Kareem Mouhannad El-Sadi, Houston, TX (US); Brandon McFarlane Foote, Houston, TX (US); Philip Adam Vogelsberg, Katy, TX (US); Eric David Schumacker, Houston, TX (US); Rene Hernandez Arces, Tomball, TX (US)

(73) Assignee: SHELL USA, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/202,676

(22) Filed: Mar. 16, 2021

(65) Prior Publication Data

US 2021/0198948 A1 Jul. 1, 2021

Related U.S. Application Data

(63) Continuation of application No. 16/588,225, filed on Sep. 30, 2019, now Pat. No. 10,982,490.

(60) Provisional application No. 62/880,714, filed on Jul. 31, 2019.

(51) Int. Cl.

| | |
|---|---|
| ***E21B 7/04*** | (2006.01) |
| ***E21B 7/06*** | (2006.01) |
| ***E21B 43/30*** | (2006.01) |

(52) U.S. Cl.
CPC ..... *E21B 7/046* (2013.01); *E21B 7/06* (2013.01); *E21B 43/305* (2013.01)

(58) Field of Classification Search
CPC ..... E21B 43/305; E21B 7/046
See application file for complete search history.

(56) References Cited

U.S. PATENT DOCUMENTS

2011/0247816 A1* 10/2011 Carter, Jr. ..... E21B 43/305 166/298
2015/0096806 A1* 4/2015 Fonseca Ocampos . E21B 7/001 175/91
2015/0337652 A1 11/2015 Rodney
2016/0215605 A1* 7/2016 Fontenot ..... E21B 43/14

(Continued)

OTHER PUBLICATIONS

Pradyumna et al., "Advanced Snake Drill Technique: Method for Improving of Oil Extraction Percentage", SPE PDPU Fest 2016, 7 pages.

(Continued)

*Primary Examiner* — Kristyn A Hall
(74) *Attorney, Agent, or Firm* — SHELL USA, INC.

(57) ABSTRACT

A horseshoe lateral is drilled having two substantially parallel lateral sections connected with a horseshoe section. The horseshoe section may be obtained by steering a drill bit within a first plane over an in-plane angle of about 180°, and then continuing drilling along a straight path. A second lateral well system may drilled from a second borehole section, to create an additional lateral section interdigitally arranged between the previous two substantially parallel lateral sections.

20 Claims, 3 Drawing Sheets

(56) References Cited

U.S. PATENT DOCUMENTS

| | | | | |
|---|---|---|---|---|
| 2016/0230526 | A1* | 8/2016 | Crews | E21B 43/26 |
| 2018/0045850 | A1 | 2/2018 | Smidth et al. | |

OTHER PUBLICATIONS

Wood, "Drilling Uphill", Geo Expro, vol. 7, Issue No. 3, May 2010, pp. 64-68.

Johan, "Combination of Snake Well Design & Smart Completions: Key Enablers for Champion West Development", SPE 88524, SPE Asia Pacific Oil and Gas Conference and Exhibition, Oct. 18-20, 2004, 7 Pages.

Obendrauf et al., Smart Snake Wells in Champion West—Expected and Unexpected Benefits from Smart Completions, SPE 100880, SPE Asia Pacific Oil & Gas Conference and Exhibition, Sep. 11-13, 2006, 6 Pages.

* cited by examiner

LATERAL BOREHOLES IN AN EARTH FORMATION

CROSS REFERENCE TO RELATED APPLICATIONS

This is a Continuation Application of U.S. application Ser. No. 16/588,225, filed 30 Sep. 2019, which claims priority benefit of U.S. Provisional Application No. 62/880,714 filed 31 Jul. 2019, both of which are incorporated herein by reference in its entirety.

FIELD OF THE INVENTION

The present invention relates to hydrocarbon fluid producing wells comprising lateral sections, and methods of drilling lateral boreholes in an Earth formation.

BACKGROUND TO THE INVENTION

Particularly when drilling in unconventional oil and gas fields, use is made of so-called horizontal, or lateral, drilling. In this technique, a well is drilled downward towards a target formation layer (which is generally a producible Earth stratum). When the target formation layer has been reached sufficiently closely, the "polar" drilling angle is steered towards a horizontal inclination (known as "building") until the borehole is within the target formation layer and the drilling direction is parallel to the formation layer. The portion of the well that is drilled horizontally is called a lateral. The lateral allows the well to come into contact with a larger amount of the producing target layer in the Earth formation. This is especially attractive in thinner rock layers.

In practice, parallel lateral wells are drilled, either as a multilateral in "pitch fork" formation from a common vertical section, or each drilled from surface. Sometimes, parallel assisting lateral wells are interdigitally arranged between parallel laterals of primary producing wells. Reference is made to FIG. 1 for a schematic illustration of such a lateral well design.

SUMMARY OF THE INVENTION

In one aspect, there is provided a method of drilling a lateral borehole in an Earth formation, comprising:

- commencing drilling from surface in a first drilling direction, at a first angle relative to a vertically downward direction;
- building to a second drilling direction at a second angle relative to the vertically downward direction, which second angle is larger than the first angle;
- defining a first plane that is parallel to said second drilling direction and parallel to an auxiliary direction that is both horizontal and perpendicular to said second drilling direction;
- continuing drilling in said first plane and in said second drilling direction;
- steering said drilling within said plane whereby changing direction of drilling from the second drilling direction to a third drilling direction;
- continuing drilling along a straight path in said plane in the third drilling direction, wherein the third drilling direction differs by between 90° and 270° from the second drilling direction.

In another aspect, there is provided a method of drilling a lateral borehole in an Earth formation, comprising:

- commencing drilling from surface in a first drilling direction, at a first angle relative to a vertically downward direction, towards a hydrocarbon fluid containing Earth stratum;
- building to a second drilling direction at a second angle relative to the vertically downward direction, which second angle is larger than the first angle;
- defining a first plane that is parallel to said second drilling direction and parallel to an auxiliary direction that is both parallel to a stratal horizon associated with said hydrocarbon fluid containing Earth stratum in proximity to the borehole and perpendicular to said second drilling direction;
- continuing drilling in said first plane and in said second drilling direction;
- steering said drilling within said first plane whereby changing direction of drilling from the second drilling direction to a third drilling direction;
- continuing drilling along a straight path in said first plane in the third drilling direction, wherein the third drilling direction differs by between 90° and 270° from the second drilling direction.

In still another aspect, there is provided a hydrocarbon fluid producing well comprising borehole in an Earth formation, said borehole comprising:

- a first section drilled from surface in a first drilling direction, at a first angle relative to a vertically downward direction;
- a second section drilled in a second drilling direction at a second angle relative to the vertically downward direction, which second angle is larger than the first angle;
- a building section connecting the first section and the second section;
- a third section drilled along a straight path in a third drilling direction, in a first plane defined parallel to said second drilling direction and parallel to an auxiliary direction that is both horizontal and perpendicular to said second drilling direction, wherein the third drilling direction differs by between 90° and 270° from the second drilling direction;
- a horseshoe section within said first plane connecting the second section and the third section.

In yet another aspect, there is provided a hydrocarbon fluid producing well comprising borehole in an Earth formation, said borehole comprising:

- a first section drilled from surface in a first drilling direction, at a first angle relative to a vertically downward direction towards a hydrocarbon fluid containing Earth stratum;
- a second section drilled in a second drilling direction at a second angle relative to the vertically downward direction, which second angle is larger than the first angle;
- a building section connecting the first section and the second section;
- a third section drilled along a straight path in a third drilling direction, in a first plane defined parallel to said second drilling direction and parallel to an auxiliary direction that is both parallel to a stratal horizon associated with said hydrocarbon fluid containing Earth stratum in proximity to the borehole and perpendicular to said second drilling direction, wherein the third drilling direction differs by between 90° and 270° from the second drilling direction;
- a horseshoe section within said first plane connecting the second section and the third section.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION OF THE INVENTION

The person skilled in the art will readily understand that, while the detailed description of the invention will be illustrated making reference to one or more embodiments, each having specific combinations of features and measures, many of those features and measures can be equally or similarly applied independently in other embodiments or combinations.

Figure 1:
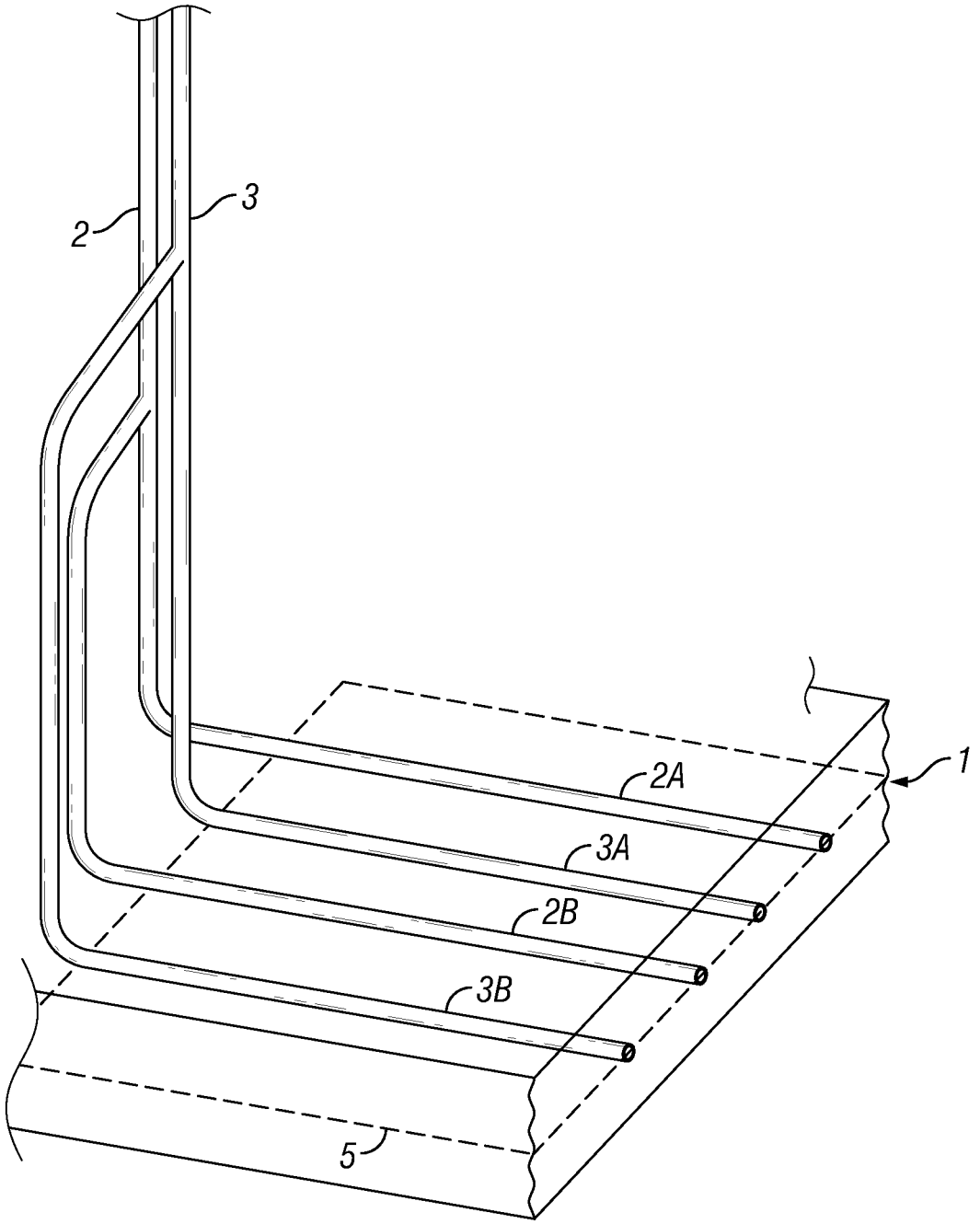
FIG. 1 schematically shows a perspective view of a first lateral well design.

FIG. 1 shows a schematic perspective view of an Earth stratum 1 which forms a target formation layer in the Earth for one or more borehole laterals. The Earth stratum 1 is approached from surface (not shown) via first section of a first borehole system, which is a vertical borehole section 2. Vertical, in this context, is not necessarily true vertical but it generally could include any angle closer to true vertical than the lateral borehole sections 2*a* and 2*b*. At a certain kick-off point, a building section begins, where the drilling trajectory starts to curve to a more horizontal direction, and it ends in a horizontal plane 5 within the stratum 1. The lateral sections 2*a* and 2*b* extend within the plane 5 and parallel to each other. In this context, parallel does not have to be truly parallel. Typically, the directions may deviate within 10° from true parallel. Also shown in FIG. 1 is a second borehole 3, which has similar lateral sections 3*a* and 3*b* interdigital arranged between the parallel lateral sections 2*a* and 2*b* of the first borehole system substantially within the same plane 5. Substantially within, in this context, means within a proximity of about 15 m from the plane.

Other ways of drilling lateral sections include drilling a dedicated wellbore for each lateral, only drilling one lateral section in outward direction until target depth (TD).

Figure 2:
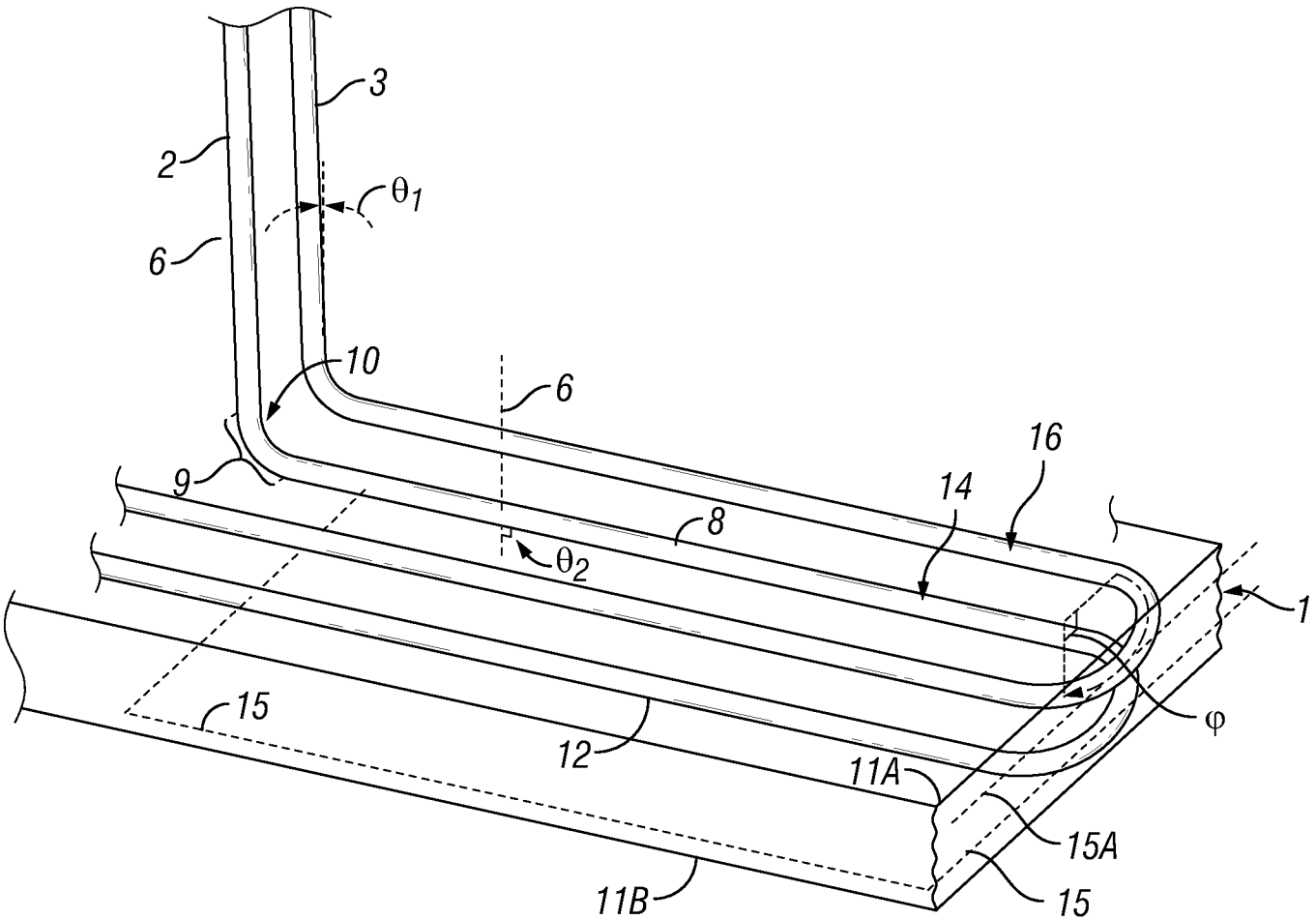
FIG. 2 schematically shows a perspective view of a second lateral well design involving a horseshoe section.
Figure 3:
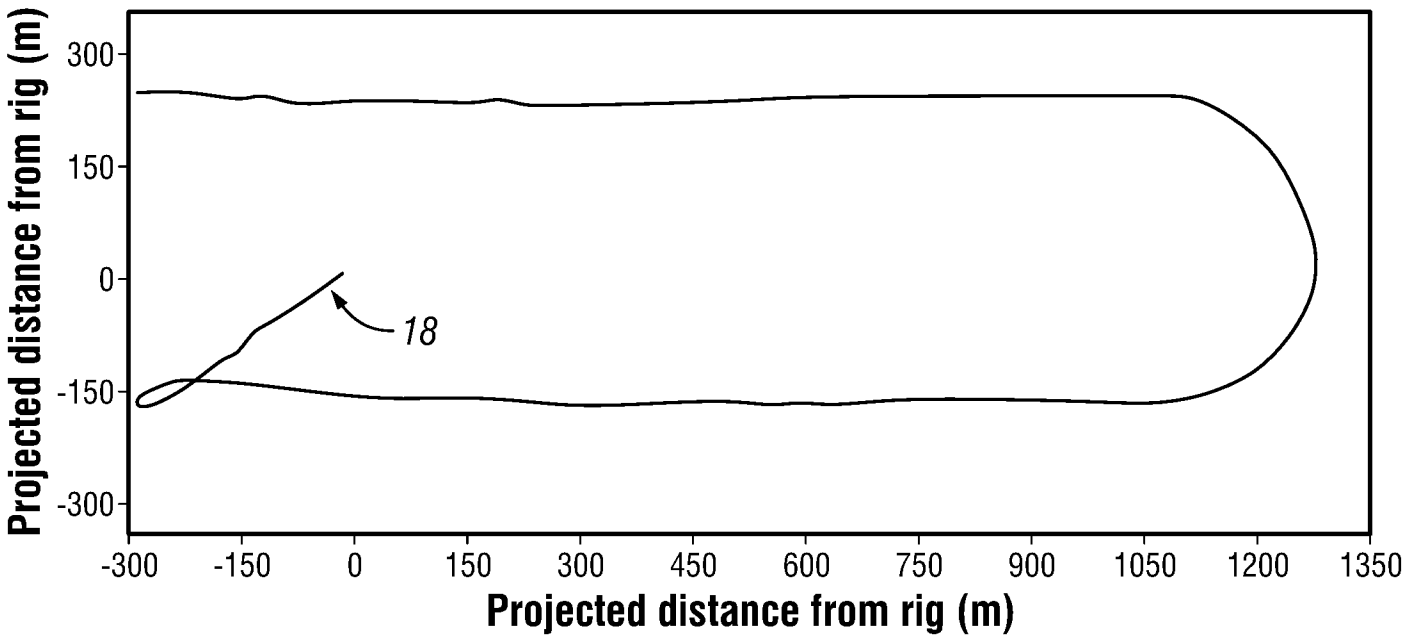
FIG. 3 shows a vertical view on actual survey results of a borehole drilled in accordance with an embodiment of the invention.

FIG. 2 shows a schematic perspective view of a newly proposed lateral well design, which has two substantially parallel lateral sections connected with a horseshoe section. The horseshoe section brings the "toe" end of the lateral closer to the "heel" end. This design may be referred to as "horseshoe lateral" or "U-bend lateral". The design comprises a first section 2 drilled from surface in a first drilling direction, at a first angle $\theta_1$ relative to a true vertically downward direction 6. A second section 8, drilled in a second drilling direction at a second angle $\theta_2$ relative to the vertically downward direction, which second angle is larger than the first angle. The second drilling direction is preferably within 10° from true horizontal. A building section 9 connects the first section 2 and the second section 8. The building section 9 may start at a kick-off point 10. The second section 8 is within an Earth stratum 1, and within a plane 15, which may preferably span substantially parallel to the upper face 11*a* and/or lower face 11*b* of the Earth stratum 1.

The lateral well design of FIG. 2 further comprises a third section 12, drilled along a straight path in a third drilling direction. The third section is within plane 15, which defined parallel to the second drilling direction, and parallel to an auxiliary direction perpendicular to said second drilling direction. The auxiliary direction is preferably horizontal relative to the horizon of the Earth stratum 1 (the stratal horizon) as seen from the second drilling direction. The stratal horizon corresponds to the in-plane directions of the Earth layer 1 in which the lateral sections are drilled. This may coincide with true horizontal, but Earth strata are sometimes dipped in which case the stratal horizon may have a certain dip angle with the true horizon.

In the embodiment shown in FIG. 2, the third drilling direction differs by 180° from the second drilling direction. In other words, within the plane 15, the third section 12 and the second section 8 are essentially parallel to each other. A horseshoe section 14 connects the second section 8 and the third section 12. The horseshoe section 14 also is substantially within the plane 15. As seen in vertical projection, the lateral well of FIG. 2 has a U shape where the bottom of the U corresponds to the horseshoe section 14.

It is envisaged that a second lateral well system is drilled, starting from a second vertical borehole section 3, and according to a similar drilling plan as described above. This way, the interdigital design of FIG. 1 can be replicated. Obviously, physical intersections of the two well systems should be avoided and hence the laterals of second borehole system may be drilled in a second plane 15*a*, at a slightly different true vertical depth. The horseshoe section 16 of the second borehole system may thus cross the first horseshoe section 14 in a second plane 15*a* which is essentially parallel displaced from the first plane 15. Alternatively, a conventional single lateral section may be drilled approximately half way between the second section 8 and third section 12 of the horseshoe lateral, which single lateral ends somewhere in the vicinity of the horseshoe section 14. Such a single lateral can be drilled within the same plane as the horseshoe lateral, as it will not intersect the horseshoe lateral.

The apex of the horseshoe sections 14,16 may be close to a drilling rights limit line of a drilling plot or fictive a hard line. A drilling rights limit line is generally a border of a plot of land beyond which subsurface drilling is not allowed. This can for example be a land lease line or a land ownership line. Sometimes, the drilling rights limit line may be located at a predetermined distance from the actual plot boundary within the plot (a so-called hard line limit).

A horseshoe lateral as described above may be drilled in accordance with a method, comprising:

- commencing drilling from surface in a first drilling direction, at a first angle $\theta_1$ relative to a vertically downward direction, to create the first section 2;
- building to a second drilling direction at a second angle θ2 relative to the vertically downward direction, which second angle is larger than the first angle;
- defining a first plane 15 that is parallel to said second drilling direction and parallel to an auxiliary direction that is perpendicular to said second drilling direction;
- continuing drilling in said first plane 15 and in said second drilling direction, to create the second section 8. Instead of calling TD at this point, the method provides in continued drilling of additional lateral length, whereby:
- steering said drilling within said first plane over an in-plane angle φ of about 180° to create the horseshoe section 14;
- continuing drilling along a straight path in said first plane in a third drilling direction, to create the third section 12, wherein the third drilling direction differs by about 180° from the second drilling direction.

The proposed method saves significant amount of time by not having to drill new vertical sections and not having to relocate the rig. The length of producible lateral wellbore may be doubled for each dedicated wellbore.

As described above, the borehole being drilled in said plane is within a single Earth stratum 1, which may be a hydrocarbon producing Earth stratum. The second drilling direction may be within 10° from horizontal, particularly if the Earth stratum 1 is at a dip, to be able to follow the Earth stratum. The first, second and third sections of the horseshoe laterals may be substantially drilled using rotary steerable system. However, to drill the horseshoe section 14, a trip may be made to change to a bent-sub motor. Furthermore, agitator sub and shock subs (combined and/or stand-alone) may be employed to reduce friction and transfer weight on bit. During said steering to create the horseshoe section 14, borehole may be drilled tangentially to a drilling rights limit line of a drilling plot.

Figure 4:
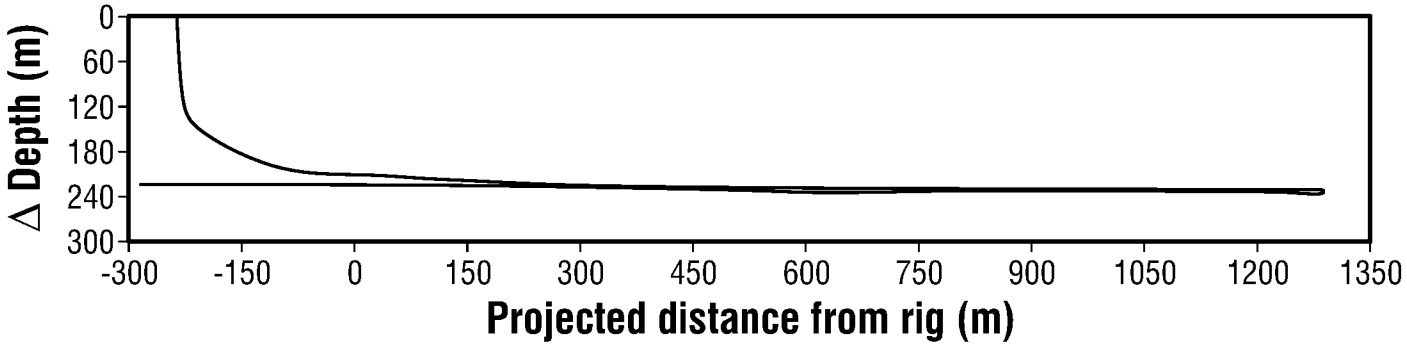
FIG. 4 shows a side view of the survey results of FIG. 3.

FIGS. 4 and 5 show survey results of an actual well having been drilled in accordance with the foregoing. FIG. 4 is a vertical downward view and FIG. 5 is a partial side view along the drilling plane 15 of only the last 240 m of true depth to better visualize the lateral sections. The rig is located at 18. It can be seen that the second and third sections are on average within the same, slightly tilted, plane. Deviations of the second and third sections from the average plane stay within about 40 ft (12 m), and most deviations stay within about 15 ft (5 m) from the average plane. The bend radius of the horseshoe section was about 200 m, but generally could be selected based on relevant criteria such as permeability of the formation and fracking considerations. A typical range for bend radius could be example between 100 m to 500 m.

The laterals of FIGS. 4 and 5 extend over about 1600 m. However, it is contemplated that shorter or longer laterals can be drilled in the same or similar manner.

The embodiments so far have been described as having U shape when seen in a vertical projection, whereby the third drilling direction differs by about 180° from the second drilling direction. However, the invention is not limited to this particular layout. More generally, the third drilling direction may differ from the second drilling direction by between 90° and 270°. In a subset of embodiments, the third drilling direction differs by between 90° and 225° from the second drilling direction. In another subset of embodiments, the third drilling direction differs by between 135° and 225° from the second drilling direction. In still another subset of embodiments, the third drilling direction differs by between 160° and 200° from the second drilling direction.

In many circumstances the Earth strata are sufficiently flat over the drilling range to describe the invention using the concept of a plane in which the lateral sections and the horseshoe section are drilled. However, in exceptional cases the target stratum may be curved somewhat, in which case the fictive plane in which the lateral sections and the horseshoe section are drilled may curve along with the stratum.

The person skilled in the art will understand that the present invention can be carried out in many various ways without departing from the scope of the appended claims.

What is claimed is:

1. A method of drilling a lateral borehole in an Earth formation, comprising:

commencing drilling from surface in a first drilling direction, at a first angle relative to a vertically downward direction, whereby creating a first section of the borehole;

building to a second drilling direction at a second angle relative to the vertically downward direction, which second angle is larger than the first angle;

defining a first plane that is parallel to said second drilling direction and parallel to an auxiliary direction that is both horizontal and perpendicular to said second drilling direction;

continuing drilling in said first plane and in said second drilling direction whereby creating a second section of the borehole;

steering said drilling within said first plane whereby changing direction of drilling from the second drilling direction to a third drilling direction;

continuing drilling along a straight path in said first plane in the third drilling direction, whereby creating a third section of the borehole, wherein the third drilling direction differs by about 180° from the second drilling direction.

2. The method of claim 1, wherein the borehole being drilled in said first plane is within a single Earth stratum.

3. The method of claim 1, wherein the borehole being drilled in said first plane is within a single hydrocarbon producing Earth stratum.

4. The method of claim 1, wherein said second drilling direction is within 10° from horizontal.

5. The method of claim 1, wherein after drilling the borehole, seen in a vertical projection, has a U shape.

6. The method of claim 1, further comprising drilling an additional lateral section from a second borehole section from surface, and extending interdigitally between the second section and third section.

7. The method of claim 6, wherein said additional lateral section is drilled in said first plane.

8. The method of claim 6, wherein said additional lateral section is drilled in a second plane which is essentially parallel displaced from said first plane.

9. A hydrocarbon fluid producing well comprising borehole in an Earth formation, said borehole comprising:

a first section drilled from surface in a first drilling direction, at a first angle relative to a vertically downward direction;

a second section drilled in a second drilling direction at a second angle relative to the vertically downward direction, which second angle is larger than the first angle;

a building section connecting the first section and the second section;

a third section drilled along a straight path in a third drilling direction, in a first plane defined parallel to said second drilling direction and parallel to an auxiliary direction that is both horizontal and perpendicular to said second drilling direction, wherein the third drilling direction differs by about 180' from the second drilling direction;

a horseshoe section within said first plane connecting the second section and the third section;

wherein the first, second, horseshoe, and third sections are formed in a continuous path drilled in sequence.

10. The hydrocarbon fluid producing well of claim 9, wherein the borehole being drilled in said first plane is within a single Earth stratum.

11. The hydrocarbon fluid producing well of claim 9, wherein said second drilling direction is within 10° from horizontal.

12. The hydrocarbon fluid producing well of claim 9, wherein after drilling the borehole, seen in a vertical projection, has a U shape.

13. The hydrocarbon fluid producing well of claim 9, further comprising an additional lateral section connected to a second borehole section from surface, and extending interdigitally between the second section and third section.

14. The hydrocarbon fluid producing well of claim 13, wherein said additional lateral section extends within said first plane.

15. The hydrocarbon fluid producing well of claim 13, wherein said additional lateral section extends within a second plane which is essentially parallel displaced from said first plane.

16. A method of drilling a lateral borehole in an Earth formation, comprising:

commencing drilling from surface in a first drilling direction, at a first angle relative to a vertically downward direction, towards a hydrocarbon fluid containing Earth stratum;

building to a second drilling direction at a second angle relative to the vertically downward direction, which second angle is larger than the first angle;

defining a first plane that is parallel to said second drilling direction and parallel to an auxiliary direction that is both parallel to a stratal horizon associated with said hydrocarbon fluid containing Earth stratum in proximity to the borehole and perpendicular to said second drilling direction;

continuing drilling in said first plane and in said second drilling direction;

steering said drilling within said first plane whereby changing direction of drilling from the second drilling direction to a third drilling direction;

continuing drilling along a straight path in said first plane in the third drilling direction, wherein the third drilling direction differs by about 180° from the second drilling direction.

17. The method of claim 16, wherein the borehole being drilled in said first plane is exclusively within said hydrocarbon fluid producing Earth stratum.

18. The method of claim 16, wherein at least one of said second drilling direction and said auxiliary direction is within 10° from horizontal.

19. The method of claim 16, wherein after drilling the borehole, seen in a vertical projection, has a U shape.

20. A hydrocarbon fluid producing well comprising borehole in an Earth formation, said borehole comprising:

a first section drilled from surface in a first drilling direction, at a first angle relative to a vertically downward direction towards a hydrocarbon fluid containing Earth stratum;

a second section drilled in a second drilling direction at a second angle relative to the vertically downward direction, which second angle is larger than the first angle;

a building section connecting the first section and the second section;

a third section drilled along a straight path in a third drilling direction, in a first plane defined parallel to said second drilling direction and parallel to an auxiliary direction that is both parallel to a stratal horizon associated with said hydrocarbon fluid containing Earth stratum in proximity to the borehole and perpendicular to said second drilling direction, wherein the third drilling direction differs by about 180° from the second drilling direction;

a horseshoe section within said first plane connecting the second section and the third section;

wherein the first, second, horseshoe, and third sections are formed in a continuous path drilled in sequence.

* * * * *